US006244912B1

(12) United States Patent
Quadrini et al.

(10) Patent No.: US 6,244,912 B1
(45) Date of Patent: Jun. 12, 2001

(54) STRUT-MOUNTED MARINE PROPULSION UNIT

(75) Inventors: Michael A. Quadrini, Westerly, RI (US); Pieter Van Dine, Mystic, CT (US)

(73) Assignee: Electric Boat Corporation, Groton, CT (US)

( * ) Notice: Subject to any disclaimer, the term of this patent is extended or adjusted under 35 U.S.C. 154(b) by 0 days.

(21) Appl. No.: 09/531,340

(22) Filed: Mar. 20, 2000

(51) Int. Cl.[7] ..... B60L 11/02
(52) U.S. Cl. ..... 440/6; 440/67; 440/80
(58) Field of Search ..... 440/38, 6, 49, 440/80, 81, 82, 67

(56) References Cited

U.S. PATENT DOCUMENTS 2,974,628 * 3/1961 Erlbacher ..... 440/82
3,137,265 * 6/1964 Meyerhoff ..... 440/67
3,266,733 * 8/1966 Goehler ..... 440/41
4,074,652 * 2/1978 Jackson ..... 440/81
5,101,128 * 3/1992 Veronesi et al. ..... 440/6
5,445,545 * 8/1995 Draper ..... 440/6

* cited by examiner

*Primary Examiner*—Stephen Avila
(74) *Attorney, Agent, or Firm*—Baker Botts L.L.P.

(57) ABSTRACT

A marine propulsion unit supported from a vessel by a strut contains an electric motor within a housing and a forward propeller driven by the electric motor and having a diameter larger than that of the housing. Hydrodynamic vanes projecting from the surface of the housing counteract tangential flow generated by the forward propeller. An aft section with a pair of counter-rotating blade rows driven by the electric motor is mounted at the rear of the housing and including a shroud surrounding the aft blade rows. The shroud is spaced from the housing so as to receive the boundary layer of liquid passing along the surface of the housing to inhibit cavitation and improve efficiency. Rearward portions of the shroud are movable to form a clamshell causing a reversal of the flow of the liquid passing through the shroud.

9 Claims, 1 Drawing Sheet

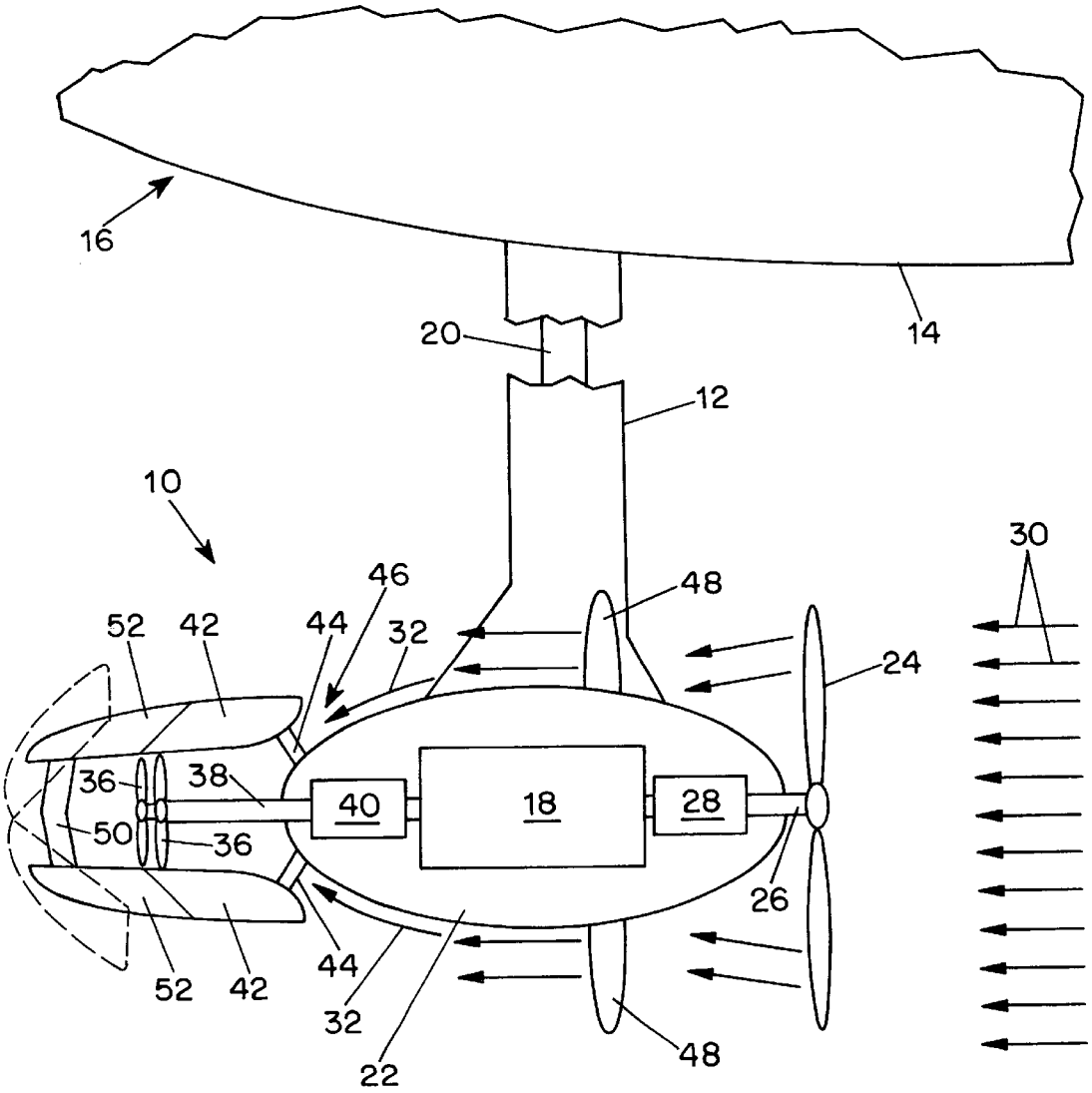
16
14
20
12
10
30
46
48
52
42
44
32
24
36
38
40
18
28
50
36
26
52
42
44
32
22
48

STRUT-MOUNTED MARINE PROPULSION UNIT

BACKGROUND OF THE INVENTION

This invention relates to propulsion units for marine vessels and, more particularly, to propulsion units for marine vessels which are supported by a strut extending from a hull of a vessel.

Conventional propulsion arrangements for surface ships are generally internally powered shaft-driven propeller-type systems in which the propeller shaft passes through the ship's hull at an angle to facilitate the layout of the propulsion plant equipment within the ship due to the typical hull geometry. Such angled shafting reduces propeller efficiency. Moreover, the typical geometry of the hull of a marine vessel does not provide uniform inflow to such a propeller which also reduces propeller efficiency.

The patents to Kirin U.S. Pat. No. 1,595,949, Pierce U.S. Pat. No. 1,910,561, Billing U.S. Pat. No. 2,372,247 and Waterval U.S. Pat. No. 2,691,356 disclose coaxial dual propeller drives for ships. The Waterval patent describes a coaxial dual propeller drive arrangement in an offset pod supported by a strut through which a mechanical drive connection is provided. The patents to Clark U.S. Pat. No. 3,528,383, Lemont U.S Pat. No. 5,292,088, Lashman U.S Pat. No. 5,634,423 and Itima et al. U.S. Pat. No. 5,848,922 disclose shrouded propeller arrangements for marine vessels arranged to produce a desired flow of water to the propeller. The Tank et al. U.S. Pat. No. 1,691,593 discloses an aircraft propulsion pod supported by struts from an aircraft wing powering a pusher propeller and containing an internal fan to pump air to the cylinders of the drive motor. The Niemi U.S. Pat. No. 5,679,045 discloses a propulsion device supported by a strut in spaced relation to a ship's hull in which electrical power is transmitted through the strut to an electric motor in the pod which drives a propeller.

SUMMARY OF THE INVENTION

Accordingly, it is an object to the present invention to provide a strut-mounted marine propulsion unit which overcomes disadvantages of the prior art.

Another object of the invention is to provide a strut-mounted marine propulsion unit which does not require engine room disruption or hull cuts for maintenance and/or replacement of a propulsion motor and which produces a more efficient propulsive force for a marine vessel.

A further object to the invention is to provide a strut-mounted marine propulsion unit arranged to utilize the boundary layer flow along the housing for the unit to improve propulsion efficiency and to provide improved cavitation performance, thereby permitting an increase in the time interval between scheduled maintenanee-operations.

These and other objects to the invention are attained by providing a propulsion unit for marine vessels which contains an electric motor within a housing, a forward propeller driven by the electric motor and having a diameter larger than the housing for the electric motor, and an aft section with a shrouded propulsion unit positioned to take in the boundary layer flowing along the housing and containing at least one row of blades driven by the electric motor. The motor housing is supported in spaced relation from the hull of the marine vessel by a strut in such a way as to insure that a uniform flow velocity profile is generated by the forward propeller for fluid directed around the housing and toward the inlet to the aft section. If appropriate, hydrodynamic vanes are mounted on the housing and project into the flow produced by the forward propeller to reduce tangential forces resulting from the propeller rotation. Further, hydrodynamic vanes are provided at the inlet to the aft section and, if desired, counter-rotating blade sections can be provided within the aft section. In addition, the shroud for the aft section may include flow-reversing clamshells of the like to reduce stopping distances for the vessel or assist in maneuvering the vessel. The strut mounting for the propulsion unit facilitates removal of the propulsion unit for replacement, maintenance and servicing.

BRIEF DESCRIPTION OF THE DRAWING

Further objects and advantages of the invention will be apparent from a reading of the following description in conjunction with the accompanying single drawing FIGURE which is a schematic plan view illustrating a representative embodiment of a strut-mounted marine propulsion unit arranged in accordance with the invention.

DESCRIPTION OF PREFERRED EMBODIMENTS

In the typical embodiment of the invention shown in the drawing, a marine propulsion unit 10 is supported by a strut 12 from the hull 14 of a marine vessel 16 which is only partially illustrated. An electric motor 18 in the propulsion unit 10 receives electric power from the vessel 16 through a cable 20 extending through the strut 12. The electric motor 18 is enclosed in a housing 22 which is shaped to produce hydrodynamically efficient flow of water around the housing. A forward propeller 24 mounted in front of the housing on a shaft 26 is driven by the electric motor through a gear box 28 which may be omitted if the desired rotational speed of the propeller can be provided directly from the electric motor 18.

The strut 12 is long enough and is positioned appropriately to locate the propulsion unit 10 in a region in which water adjacent to the vessel passes with uniform flow toward the propeller 24 as indicated in the drawing by the arrows 30. Moreover, the diameter of the propeller 24 is larger than the diameter of the housing 22, so that it drives water along the outer surface of the housing essentially parallel to the direction of motion of the propulsion unit, producing a boundary layer 32 which follows the surface of the housing 22. At the rear of the housing a single blade row or two counter-rotating blade rows 36 are supported on a shaft 38 which is connected to a gear box 40 within the housing. The gear box may be omitted if the desired rotational speed of the blade rows can be provided directly from the motor 18.

A shroud 42 surrounding the blade rows 36 is supported from the housing by stationary vanes 44 which tend to guide the boundary layer 32 into the space 46 between the shroud 42 and the housing 22. The vanes 44, as well as an array of vanes 48 projecting radially outwardly from the surface of the housing 22, reduce any tangential flow-of the liquid passing along the surface of the housing 42 which may be induced by rotation of the forward propeller 24. By ingesting the boundary layer 32 into the shroud surrounding the blade rows 36, cavitation is inhibited and the efficiency of the operation of the propulsion unit is improved. Additional vanes 50 mounted at the rear of the shroud 42 reduce any tangential flow of liquid resulting from rotation of the blades 36 as the liquid emerges from the shroud 42.

In order to facilitate maneuverability of the marine vessel to which the propulsion unit is attached, the shroud 42 can contain pivotable rear sections 52, which can be pivoted to the positions shown in dotted lines in the drawing to provide a clamshell arrangement by which the water passing through the shroud emerges in the reverse direction, thereby facilitating maneuverability or stopping of the vessel.

By providing a propulsion unit which is strut-mounted from a hull in such a way that it receives a uniform flow pattern and by guiding the boundary layer from the housing into the shroud surrounding the aft section of the propulsion unit, improved cavitation performance and efficiency of operation are provided and consequently, less maintenance is necessary. This is in contrast to conventional pump jet systems mounted within the hull of a vessel, which require higher rotating blade velocities, and consequently, increased maintenance as well as reduced efficiency resulting from a nonaxial water flow path. With the described arrangement, maximum torque is transferred to the fluid by the forward propeller and swirl is reduced by the vanes mounted on the housing while the shrouded aft section improves efficiency by recovering the boundary layer. For maintenance or replacement, the propulsion unit can be separated easily from the hull of the vessel and the motor can be removed from the housing by a simple procedure.

Although the invention has been described herein with reference to specific embodiments, many modifications and variations therein will readily occur to those skilled in the art. Accordingly, all such variations and modifications are included within the intended scope of the invention.

We claim:

1. A marine propulsion unit for driving a marine vessel comprising;

an electric motor enclosed in a housing;

a strut for supporting the electric motor and housing in spaced relation to a marine vessel and for providing electrical power to the motor from a power source within the vessel;

a forward propeller supported on a shaft at the forward end of the housing and driven by the electric motor;

a rear blade row supported on a shaft at the rear end of the housing having a diameter smaller than that of the housing and driven by the electric motor, the housing tapering inwardly toward the blade row; and a shroud surrounding the rear blade row and spaced from the electric motor housing to provide an inlet opening through which the boundary layer passing along the housing is drawn inwardly toward the blade row to reduce cavitation.

2. A marine propulsion unit according to claim 1 wherein the shroud surrounds a second blade row rotating in the opposite direction with respect to the first blade row.

3. A marine propulsion unit according to claim 1 wherein the shroud has portions which are movable to produce a clamshell for reversing the flow of water from the shroud.

4. A marine propulsion unit according to claim 1 including a gear box connected between the electric motor and the forward propeller for providing a gear ratio between the rotation of the motor and the rotation of the propeller.

5. A marine propulsion unit according to claim 1 including a gear box connected between the electric motor and the rear blade row for providing a gear ratio between the rotation of the electric motor and the rotation of the rear blade row.

6. A marine propulsion unit according to claim 1 wherein the diameter of the forward propeller is larger than the diameter of the housing enclosing the electric motor.

7. A marine propulsion unit according to claim 1 including a plurality of hydrodynamic vanes mounted on the housing for reducing tangential flow developed by the forward propeller.

8. A marine propulsion unit according to claim 1 including a plurality of hydrodynamic vanes within the shroud for reducing tangential flow caused by rotation of the rear blade row.

9. A marine propulsion unit according to claim 1 wherein the shroud is supported from the electric motor housing by a plurality of stationary vanes to reduce tangential flow of water entering the shroud.

* * * * *